US006374577B1

(12) United States Patent
Ventura

(10) Patent No.: US 6,374,577 B1
(45) Date of Patent: Apr. 23, 2002

(54) PRODUCE BAG BUNDLE AND BELT MOUNTED SUPPORT THEREFORE

(75) Inventor: Leon P. Ventura, Watsonville, CA (US)

(73) Assignee: Bud Antle, Inc., Salinas, CA (US)

( * ) Notice: Subject to any disclaimer, the term of this patent is extended or adjusted under 35 U.S.C. 154(b) by 0 days.

(21) Appl. No.: 09/505,300

(22) Filed: Feb. 16, 2000

(51) Int. Cl.[7] ..... B65B 67/04
(52) U.S. Cl. ..... 53/390; 206/554
(58) Field of Search ..... 53/390, 384.1, 53/459, 570, 571, 572; 24/3.12, 3.1, 3.7; 248/95, 100; 383/9; 206/554

(56) References Cited

U.S. PATENT DOCUMENTS 1,281,656 A * 10/1918 Raschick ..... 24/3.12
4,306,399 A * 12/1981 Tsujimoto et al. ..... 53/52
4,336,681 A * 6/1982 Onishi ..... 53/459
4,342,564 A * 8/1982 Lehmacher ..... 493/195
4,974,764 A * 12/1990 Cantwell ..... 224/269

* cited by examiner

*Primary Examiner*—Scott A. Smith
*Assistant Examiner*—Nathaniel Chukwurah

(74) *Attorney, Agent, or Firm*—William Michael Hynes; Townsend and Townsend and Crew LLP

(57) ABSTRACT

A belt mounted support and a group of bags for support on the belt mounted support is used in the harvest of produce. The belt mounted support includes a tube and a belt mounting loop connected to the tube. A bag supporting rod is threaded through the tube to freely rotate with two hooked bag supporting ends. A group of bags is supported on the belt mounted support, each bag formed from perforate plastic sheet. Each individual bag has a front rectilinear panel, a rear and larger rectilinear panel, and a folded gusset at a bottom of the bag folded upward between the front rectilinear panel and the rear and larger rectilinear panel. Logo on the bags is formed from an outside of the bag to be read from an inside of the bag whereby the bag is manufactured in an inverted disposition with respect to the logo. The group of bags is registered one to another at a rear panel protrusion. First fused apertures are formed in the rear panel protrusion, the first fused apertures forming apertures for receiving the hooked bag supporting end of the belt mounted support and fusing adjacent rear panel protrusions one to another. Second fused portions are formed adjacent an outside edge of the rear panel protrusions fusing adjacent rear panel protrusions one to another for disposing the bags in an open disposition when inverted for insertion of produce.

5 Claims, 2 Drawing Sheets

PRODUCE BAG BUNDLE AND BELT MOUNTED SUPPORT THEREFORE

This invention relates to produce bags used for packaging heads of produce, such as lettuce or cauliflower in the field in a ready to market carton array. More specifically, an improved bag bundle and belt mounted support for the bag bundle is disclosed.

BACKGROUND OF THE INVENTION

Produce, such as "iceberg" lettuce, is presently picked and trimmed in the field in a ready to market condition. Taking the case of lettuce, the lettuce head is cut from the root system and the outer four to six non-palatable leaves trimmed from the head. When trimmed in the field, the produce is bagged in a ventilated plastic bag, placed in a carton, shipped to a vacuum cooler and cooled, and thereafter express shipped—usually by truck—to market.

This type of picking and packing has many advantages. Specifically, when the outer non-palatable leaves of lettuce are stripped in the field, the weight shipped per carton is reduced. Taking the case of a so-called 24-head carton of iceberg lettuce, shipping weight decreases from 54 pounds to about 44 pounds. Additionally, and over the prior art "naked" pack—where the outer non-palatable lettuce leaves are not stripped away—there is no need for the grocer to trim the lettuce head at the market. Instead, the lettuce can be taken from the carton in the bag to which the lettuce was harvested and sold to the consumer without further processing.

This invention relates to the field wrapping of such produce, and specifically iceberg lettuce. So that the prior art can be completely understood, I first will describe the individual lettuce bags are manufactured. Second, I will set forth how the bags are bundled together so that they may be rapidly filled. Third, I will set forth how such bags are filled with produce, typically lettuce. Fourth and finally, I will set forth the practical problems encountered with this prior art.

The individual produce bags have a front panel, a rear panel, and a bottom gusset, which gusset forms a fold protruding into the bag at the bag bottom. The sides of the individual bags have continuous side seams joining the front and rear panels. The bottom gusset is closed at the sides of the bags by the continuous side seams and thus is fastened protruding into and occupying the bottom of the bag.

The bags have a uniform array of holes permitting cooling of the head of lettuce in a vacuum cooler, preventing spoiling contact of the lettuce head with other heads in the carton when shipped, and finally enabling the consumer to transport the lettuce home. The bag into which the lettuce is initially inserted is the bag from which the lettuce is removed in the kitchen of the consumer.

Two features of the lettuce bags can be described as unusual. First, and with respect to any labels or UPC bar codes placed on the bags, the individual bags are manufactured inside-out! Simply stated, before lettuce is placed in the bags, the bag must be reversed so that what is the inside of the bag as manufactured becomes the outside of the bag when it is filled with produce—preferably lettuce.

Second, the rear panel of such bags extends upward and beyond the front panel of such bags. Although the front panel at the top is parallel to the rear panel at the top, it is in the order of two inches below the top of the rear panel of such bags. As will hereafter be made clear, only the rear panel is utilized in forming such bags into a "wicket" or group of such bags.

The bags are dispensed to the individual pickers in a group. In the prior art, all the bags necessary to form a group are stacked overlying one another with the rear panels registered to one another. Two evenly spaced holes are punched in the rear panels of the bag tops where the tops protrude above the front panels. The evenly spaced holes have sufficient diameter so that they can accommodate a supporting wire. It is this supporting wire which enables the bags to be supported in a group of about fifty bags.

The supporting wire is bent in a "U" shaped configuration. The two sides of the "U" are threaded through the two holes through the rear panels of the group of bags. The bottom medial portion of the "U" faces the inside of the rear panel of the first to be dispensed bag from the bag wicket. The wire ends of the sides of the "U" shaped wire protrude outward from the last bag to be dispensed.

Two cardboard panels are used with each group of bags. At the front of the bag pack held in place by the bottom central portion of the "U" is a cardboard strip, which strip is about the size of the upward protruding rear panel of the bags. On the other side of the bag pack there is provided a second cardboard panel which panel has about the same size and shape as the rear panel of the bags. Finally, two rubber grommets are threaded over the protruding ends of the "U" shaped members. These rubber grommets trap and hold the rear cardboard panel and the bags as a unit on the "U" shaped wire.

The use of the group of bags in the field is not intuitive. First, the protruding ends of the wire is bent downward about 90°. These bent wire ends are then used to maintain the group of bags to the belt of the picker.

In picking and bagging produce—preferably lettuce—the picker first severs the head of lettuce from the root system. Thereafter, the outer non-palatable four to six leaves are trimmed from the head. Taking the case of a right handed picker, the head of lettuce is held in the left hand and trimmed with the right hand. It is after such trimming that the bag is ready to have the lettuce inserted to a bag.

The reader will remember that the bag has literally been manufactured "inside-out." Assuming that the head is held in the left hand of the picker, the picker pulls open the bag mouth with his right hand. Grasping the bag at the front panel, the bag then forms a continuous band through which the head of lettuce is inserted. When the bag is inserted upward through this interval, the bags is inverted with the label side on the outside. It will be understood that at this juncture the bag is literally upside down but now disposed right side out!

The left hand of the picker thereafter inserts the head of lettuce upwardly into the bag through the lower open mouth of the bag. Continuing the same motion, the bag is severed at its holes in the rear panel from the "U" shaped wire. The picker then hands the bag wrapped head of lettuce for further processing. Such processing may include mounting the bag to a grasping mechanism—usually a split PVC pipe. Finally, taping shut of the bag usually occurs (typically by another worker) followed by placement of the head to a carton for cooling, and shipping.

This rather sophisticated and elaborate prior art has difficulty. First, the "U" shaped wire, the cardboard panels, and the rubber grommets are all discarded in the field. There results in the wake of this operation, trash that is not natural to the field from which the next crop of produce—here lettuce—must be grown.

More importantly, the prior art mounting of such bags has proven other than optimum. First, the cardboard panels often become wet and soggy—especially when the conditions in the field are wet and soggy. In this wet and soggy condition, the cardboard panels no longer are planar. Likewise, the supported group of bags is no longer planar. In the usual case the bags tend to bunch and tangle together. Such bunching and tangling includes the bags "walking" along the bottom "U" shaped section of the wire. The bags at their respective supporting holes come in close contact one with another. The picker then has grave difficulty in singulating the individual bags from the group. More particularly, the large target formed by the back panel of the bag and the front edge of the bag cannot be made. With the lack of sigulation occurring from this bunching along the "U" shaped wire, picking as optimally described above cannot occur.

Finally, wind conditions can also interfere with the bags. In such conditions, the bags again slide together over the supporting wire at outside of the "U" shaped wire. The bags again become a tangled individual bag from the bulk of the remaining bags can only occur with difficulty.

The reader will understand that the named inventor herein has been harvesting produce utilizing such bags for over 20 years. He has contributed to the development of the prior art bags described above. More importantly, he has noted and here sets forth the difficulties with the prior art bags—especially how those bags are grouped together and individually dispensed to the harvesting pickers. Accordingly, invention is claimed in recognizing the problems to be solved, as well as the solution to those problems, which solution immediately follows.

SUMMARY OF THE INVENTION

A belt-mounted support and a group of supported bags is used in the harvest of produce. The belt-mounted support includes a tube and a belt mount loop connected through the tube. A bag support rod is threaded through the tube to freely rotate within the tube. The bag supporting rod has two hooked bag supporting ends. A group of bags is supported on the belt mounted support, each bag formed from perforate plastic sheet. Each individual bag has a front rectilinear panel, a rear and larger rectilinear panel, and a folded gusset at a bottom of the bag folded upward between the front rectilinear panel and the rear and larger rectilinear panel. Logo on the bags is formed from an outside of the bag to be read from an inside of the bag whereby the bag is manufactured in an inverted inside out disposition with respect to the logo. Two seams join the front rectilinear panel, rear and larger rectilinear panel, and gusset at the bag sides to form a closed inverted bag having an open top. The rear and larger rectilinear panel protrudes upward and above the front rectilinear panel to define a rear panel protrusion along the open top of the bag. The group of bags is registered one to another at the rear panel protrusion. First fused apertures are formed in the rear panel protrusion, the first fused apertures forming apertures for receiving the hooked bag supporting end of the belt mounted support and fusing adjacent rear panel protrusions one to another. Second fused portions are formed adjacent an outside edge of the rear panel protrusions fusing adjacent rear panel protrusions one to another. The first fused apertures and the second fused portions dispose the bags in an open disposition when inverted for insertion of produce. During picking, the bag opened between the front and rear seam, inverted when the mass of the head of produce is inserted through the bag. Separation and sigulation of the bag to wrap and box recently harvested lettuce head occurs.

DESCRIPTION OF THE SPECIFIC EMBODIMENTS

Figure 1:
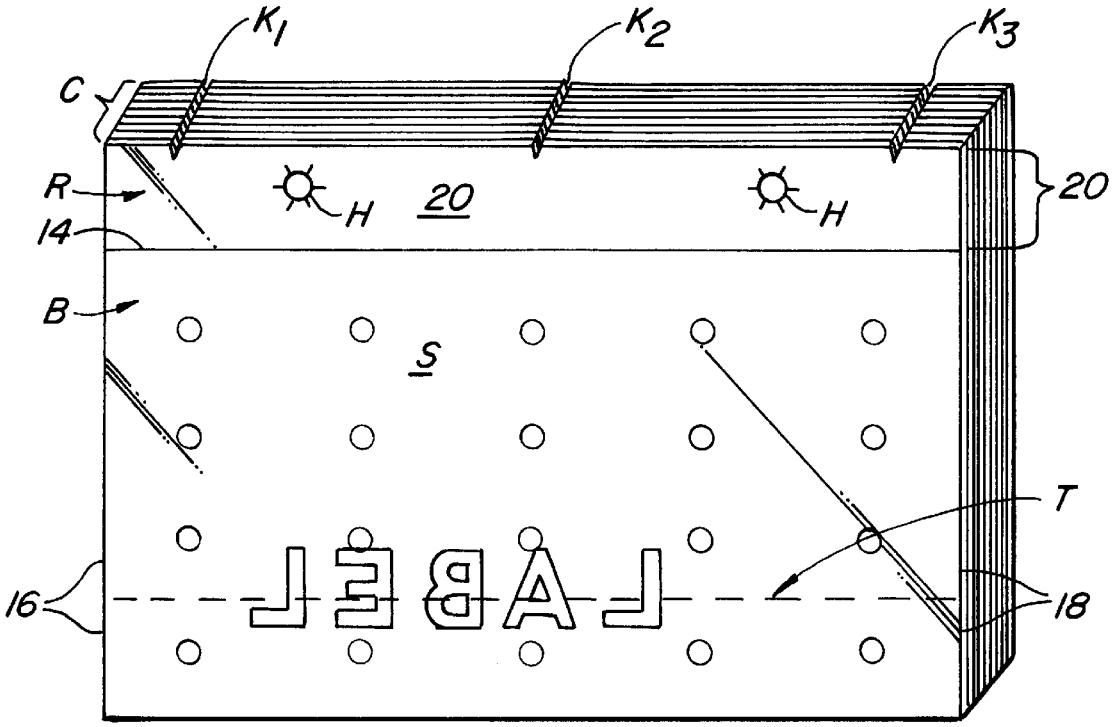
FIG. 1 is a perspective view of a group of bags illustrating in broken lines the construction of the first bag and illustrating in the perspective view a group of such bags fastened together for suspension from the belt mounted hook illustrated in FIG. 2.

Referring to FIG. 1, the group of bags G is illustrated. In what follows, I will describe the construction of the top bag B of the group of bags G. Thereafter, I will describe the group of bags G as they are fused together.

Top bag B has front panel F, rear panel R, and bottom folded gusset T. Bottom folded gusset T extends between front panel F and rear panel R and is a continuation of the perforate plastic sheet S from which the bags are constructed.

Rear panel R is rectilinear and extends the full length and width of group of bags G. Front panel F is also rectilinear but extends less than the full height of rear panel R at front panel top 14. Top bag B is provided with two continuous side seams 16, 18 which bind together respectively front panel F, rear panel R, and bottom folded gusset T.

The bag is fabricated inside out! This can be viewed at the word "LABEL" which appears imprinted on the outside of top bag B for view from the inside of top bag B as it is shown in FIG. 1.

Having described the individual bag, attention can be devoted to group of bags G.

Remembering that rear panel R is larger than front panel F, it will be seen that rear panel R at the upper edge forms rear panel protrusion 20. Bags B are stacked so that all rear protrusions 20 are registered to one another. There remains the task of fusing the stacked bags B, this fusing being accomplished by hot knife slits K and hot holes H.

Regarding hot holes H, a heated rod is driven through bags B. This heated rod melts its way through the perforate plastic sheet S fusing each rear panel protrusion 20 to the adjacent rear panel protrusions 20 of adjoining bags. Likewise, hot knife slits K are made by a hot knifes with the same result. Rear panel protrusions 20 are fused to adjacent rear channel protrusions 20.

Stopping here, the reader will understand that rear panel protrusions 20 of group of bags G are fused in no less than five places. This being the case, the top ridge of the bags tends to form a linear spine. This linear spine has been found useful in cooperation with the illustrated holder to prevent the bags from bunching together—even in the most adverse conditions. More particularly, it will be remembered that the picker pulls open the front edge of the bag. The front edge and the rear edge have to define a "band-like" target, which "band-like target" has sufficient dimension to enable the produce to be inserted through it. At the same time, the "band-like" target must have sufficient width to enable the depending mass of the bag to be pushed by the head of produce and inverted during this pushing.

Figure 2:
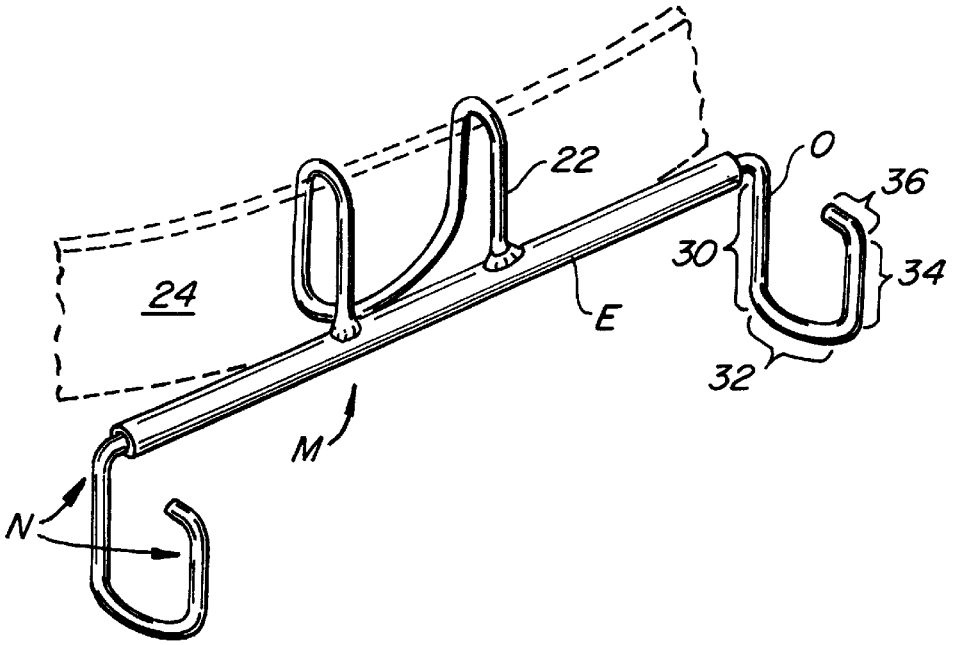
FIG. 2 is a perspective of the belt mounted hook utilized with this invention.

Referring to FIG. 2, belt mounted holder M is disclosed. Belt mounted holder M includes stainless steel tube E having loop L welded thereto. Loop L comprises U-shaped wire 22 (when viewed in side elevation section) welded to steel tube E at both ends and bent at 90° to form a "U", which "U" fastens to belt 24 of a harvest worker W (See FIGS. 3A and 3B). Rod O is threaded through steel tube E. Rod O has two identical bends N, only one of which will be described in detail.

First, rod O is bend down at 30, horizontally at 32, and upward at 34. Overall, bends 30, 32, and 34 form a "U" shaped-configuration. Secondly, rod O is finally bent inward at 36 returning toward the end of steel tube E. This bend will be seen to enable bags B to remain fastened to belt mounted holder M when separation occurs.

Having described the construction of bags B and belt mounted holder M, mounting of the bags to the holder first and operation of the bags during picking second may now be described.

Mounting of bags B as fastened in wicket C is easy to understand. Simply stated, wicket C is inverted from the disposition shown in FIG. 1, and threaded through belt mounted holder M at bend 36. Released, wicket C falls so that support from bend 32 at each end of rod O occurs. Assuming that this mounting has been made, use of the bags as illustrated in FIGS. 3A and 3B occurs.

Figure 3A:
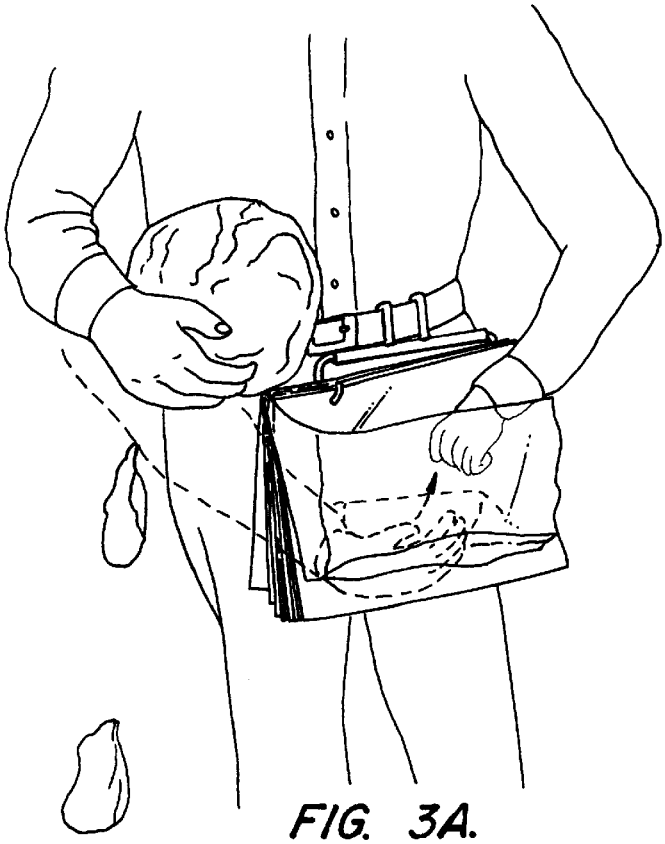
FIG. 3A illustrates picker with a cleaned head of lettuce opening and inverting a bag to dispose the open mouth of the bag for insertion of lettuce upwardly through the mouth of the bag, it being noted that the mouth of the bag is held open wide during this insertion.
Figure 3B:
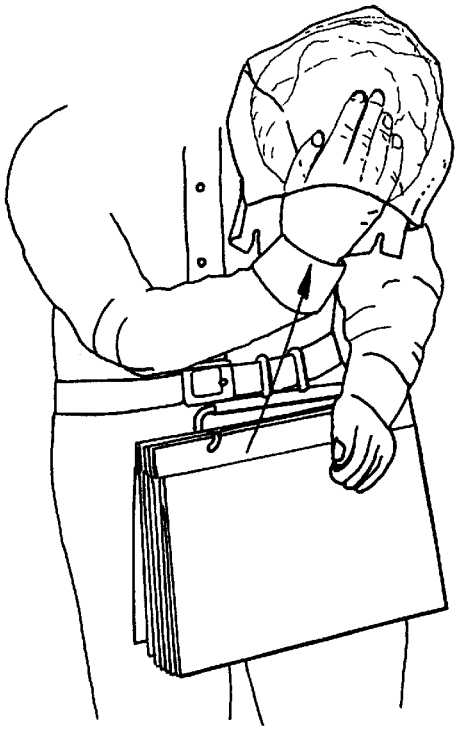
FIG. 3B illustrates the continuation of the upward motion of insertion resulting in severing and wrapping of the lettuce with the bag being passed for further processing.

Referring to FIG. 3A, the reader must understand that lettuce head D has already be trimmed of unnecessary lettuce leaves 40. In the case the particular harvest worker W, it is assumed that with knife trimming has occurred. Using the right hand the worker W pulls open the top most bag B. At this time the bulk of the inverted bag still depends downward from the rest of the bag. Worker W holding produce head in the left hand inverts top bag B by shoving produce head through the mass of the depending and inverted bag, causing the top bag B to be disposed upward and inverted. This much is shown in FIG. 3A.

Thereafter, with a continuous upward motion, lettuce head D is inserted into the open mouth of top bag B, and separated from wicket C in a continuous upward motion. Using a continuation of this upward motion, top bag B is then severed from hot holes H and hot knife slits K. Continuing the upward motion, the now trimmed and bag wrapped lettuce is delivered for further processing.

It will be understood that hot holes H and hot knife slits K result in top bag B being held in the open disposition under all field conditions in which lettuce harvesting (or other produce such as broccoli, cauliflower, cabbage and the like) can occur. Specifically, by having each of the bags fastened at five different places across the top of wicket C, it is assured that the mouth of top bag B will remain open and easy for the insertion of lettuce head D.

Second, and due to the construction of belt mounted holder M, there will be no tendency of bags B to bunch in conditions of high wind or moisture; sigulation of the bags B will easily occur. Group C of bags B because of being fastened at no less than five locations across the top of group C will remain unitary with respect to the bag being separated. Further, and when the last bags of group C are used, belt mounted holder M will maintain the remaining bags B in their depending spaced apart disposition. Improved harvest will result.

What is claimed is:

1. In combination, a belt mounted support and a group of bags for support on the belt mounted support, the combination comprising:

a belt mounted support for carrying the group of bags, the belt mounted support including, a tube;

a belt mounting loop connected to the tube, extending upwardly from the tube, and looping downward back toward the tube to enable support of the tube from a belt of a user;

a bag supporting rod threaded through the tube and freely rotatable within the tube having two hooked bag supporting ends;

each hooked bag supporting end defining a depending portion, and a hooked return portion;

each hooked bag supporting end formed parallel to a corresponding hooked bag supporting end;

a group of bags for support on the belt mounted support each formed from perforate plastic sheet including:

each individual bag having a front rectilinear panel, and a rear and larger rectilinear panel;

each individual bag further having logo, the logo being formed on an outside of the bag to be read from an inside of the bag whereby the bag is manufactured in an inverted disposition with respect to the logo;

two seams for joining the front rectilinear panel, and rear and larger rectilinear panel;

a bottom seam for joining a bottom of the front rectilinear panel to a bottom of the rear rectilinear panel to form a closed inverted bag having an open top;

the rear and larger rectilinear panel protruding upward and above the front rectilinear panel to define a rear panel protrusion along the open top of the bag;

the group of bags registered one to another at the rear panel protrusion;

first fused apertures formed between the rear panel protrusions, the first fused apertures forming apertures for receiving the hooked bag supporting end of the belt mounted support and fusing adjacent rear panel protrusions one to another; and, second fused portions adjacent an outside edge of the rear panel protrusions fusing adjacent rear panel protrusions one to another for disposing the bags in an open disposition when inverted for insertion of produce.

2. A belt mounted support for carrying a group of bags by paired spaced apart apertures in the upper portion of the bags, the belt mounted support comprising:

a tube;

a belt mounting loop connected to the tube, extending upwardly from the tube, and looping downward back toward the tube to enable support of the tube from a belt of a user;

a bag supporting rod threaded through the tube and freely rotatable within the tube having two hooked bag supporting ends;

each hooked bag supporting end defining a depending portion, and a hooked return portion; and, each hooked bag supporting end formed parallel to a corresponding hooked bag supporting end and spaced apart for receiving one of the spaced apart apertures in the upper portion of the bags.

3. A group of bags for support on the belt mounted support each formed from perforate plastic sheet including:

each individual bag having a front rectilinear panel and a rear and larger rectilinear panel;

each individual bag further having logo, the logo being formed on an outside of the bag to be read from an inside of the bag whereby the bag is manufactured in an inverted disposition with respect to the logo;

two seams for joining the front rectilinear panel, and rear and larger rectilinear panel;

a bottom seam for joining a bottom of the front rectilinear panel to a bottom of the rear rectilinear panel to form a closed inverted bag having an open top;

the rear and larger rectilinear panel protruding upward and above the front rectilinear panel to define a rear panel protrusion along the open top of the bag;

the group of bags registered one to another at the rear panel protrusion;

first fused apertures formed between the rear panel protrusions, the first fused apertures forming apertures for receiving the hooked bag supporting end of the belt mounted support and fusing adjacent rear panel protrusions one to another; and, second fused portions adjacent an outside edge of the rear panel protrusions fusing adjacent rear panel protrusions one to another for disposing the bags in an open disposition when inverted for insertion of produce;

whereby said fused apertures and said fused portions form a wicket common to the group of bags to enable opening of the top bag of a group of bags relative to the wicket.

4. A group of bags for support on the belt mounted support each formed from perforate plastic sheet according to claim 3 including:

the bottom seam for joining a bottom of the front rectilinear panel to a bottom of the rear rectilinear panel includes a gusset extending between the bottom of the front panel and the bottom of the rear panel.

5. A group of bags for support on the belt mounted support each formed from perforate plastic sheet according to claim 3 including:

the second fused portions adjacent an outside edge of the rear panel protrusions includes a plurality of fusing V-shaped grooves.

* * * * *